US009512367B2

(12) United States Patent
Augier et al.

(10) Patent No.: US 9,512,367 B2
(45) Date of Patent: Dec. 6, 2016

(54) PROCESS FOR EXTRACTING SULPHUR-CONTAINING COMPOUNDS BY LIQUID-LIQUID EXTRACTION BY MEANS OF A SODA SOLUTION WITH AN OPTIMIZED FINAL WASHING STEP

(71) Applicant: IFP Energies nouvelles, Rueil-Malmaison (FR)

(72) Inventors: Frederic Augier, Saint Symphorien d Ozon (FR); Arnaud Baudot, Vernaison (FR); Jeremy Gazarian, Condrieu (FR); Damien Leinekugel Le Cocq, Lyons (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 263 days.

(21) Appl. No.: 14/360,385

(22) PCT Filed: Oct. 16, 2012

(86) PCT No.: PCT/FR2012/000419
§ 371 (c)(1),
(2) Date: May 23, 2014

(87) PCT Pub. No.: WO2013/076384
PCT Pub. Date: May 30, 2013

(65) Prior Publication Data

US 2014/0284250 A1 Sep. 25, 2014

(30) Foreign Application Priority Data

Nov. 24, 2011 (FR) ..... 11 03594

(51) Int. Cl.
*C10G 21/28* (2006.01)
*C10G 21/30* (2006.01)
*C10G 19/02* (2006.01)
*C10G 21/08* (2006.01)

(52) U.S. Cl.
CPC ..... *C10G 21/28* (2013.01); *C10G 19/02* (2013.01); *C10G 21/08* (2013.01); *C10G 21/30* (2013.01)

(58) Field of Classification Search
CPC ..... C10G 19/02; C10G 21/08; C10G 21/28; C10G 21/30
See application file for complete search history.

(56) References Cited

U.S. PATENT DOCUMENTS

| | | | |
|---|---|---|---|
| 2,431,770 | A | 12/1947 | Payne et al. |
| 3,474,027 | A | 10/1969 | Vautrain et al. |
| 6,749,741 | B1 | 6/2004 | Laricchia et al. |
| 7,381,309 | B1 | 6/2008 | Laricchia et al. |

FOREIGN PATENT DOCUMENTS

| | | | |
|---|---|---|---|
| GB | 601978 | A | 5/1948 |

OTHER PUBLICATIONS

International Search Report for PCT/FR2012/000419 dated Feb. 14, 2013.

*Primary Examiner* — Renee E Robinson
*Assistant Examiner* — Derek Mueller
(74) *Attorney, Agent, or Firm* — Millen, White, Zelano, Branigan, P.C.

(57) ABSTRACT

Process of extracting sulphur-containing compounds from a hydrocarbon cut of the gasoline or LPG type by liquid-liquid extraction with a soda solution employing a unit (2) for pretreatment of the feedstock to be treated placed upstream of the extraction unit (4), the soda being introduced into the extraction column (4) in the form of two circuits operating either in parallel, or in series.

15 Claims, 3 Drawing Sheets

PROCESS FOR EXTRACTING SULPHUR-CONTAINING COMPOUNDS BY LIQUID-LIQUID EXTRACTION BY MEANS OF A SODA SOLUTION WITH AN OPTIMIZED FINAL WASHING STEP

FIELD OF THE INVENTION

The invention relates to the field of the extraction of sulphur-containing compounds such as mercaptans, COS and $H_2S$ from a hydrocarbon cut. This selective extraction is carried out by bringing the hydrocarbon feed in the liquid phase into contact with a soda solution.

PRIOR ART

The extraction of sulphur-containing compounds from a hydrocarbon cut (gasoline, LPG etc.) by liquid-liquid extraction with a soda solution is well known in the state of the art. When most of the sulphur-containing species are mercaptans, or thiols, a very widely used type of process consists of performing an extraction of the sulphur-containing species by means of a soda solution circulating in a loop in the process, as described in U.S. Pat. No. 4,081,354. The sulphur-containing species of the mercaptan type dissociate into sodium thiolates in the soda. After extraction, the soda laden with sodium thiolates is oxidized in the air in the presence of a dissolved catalyst, for example based on cobalt phthalocyanine. Thus, the species of the sodium thiolate type are converted to disulphides. The disulphide-rich soda solution is brought into contact with a hydrocarbon phase, which makes it possible to extract the disulphides and thus regenerate the soda solution, which can be recycled to the top of the liquid-liquid extraction column. The parameters associated with oxidation are selected so as to oxidize almost all the sodium thiolates present in the soda. The process therefore permits partial or complete desulphurization of a hydrocarbon cut, and generates another organic effluent that is heavily laden with sulphur-containing species.

The extraction in countercurrent with soda of the hydrocarbon phase leaving the pretreatment can be performed in various types of extraction columns. A great many technologies are known, for example those described in the Handbook of Solvent Extraction (Krieger Publishing Company, 1991). These columns are generally designed to generate at least 2 theoretical extraction stages. An extraction column technology often encountered is that of perforated trays with downcomers, since extraction in countercurrent with soda is often carried out with a soda flow rate well below the flow rate of the hydrocarbon. The ratio of the volume flow rates of hydrocarbon and of soda can vary between 5 and 40. The content of soda in the loop is generally fixed at a content between 15 and 25% by weight.

A problem inherent in this type of process is the fact that the residual content of sodium thiolates in the regenerated soda solution must be very well controlled. A minimum content of sodium thiolates in the soda between 10 and 60 ppm (by weight) is necessary after extraction of the disulphides, as the soda also contains a small quantity of dissolved oxygen. In fact, soda solution containing between 0.5 and 20 ppm (by weight) of oxygen is returned to the top of the countercurrent extractor, and in the absence of sodium thiolates, the residual oxygen reacts directly in the extractor with the mercaptans present in the hydrocarbon cut, forming disulphides in the organic phase that is actually undergoing desulphurization, which has an adverse effect on the overall performance of the process.

Conversely, an excessively high content of sodium thiolates, for example above 150 ppm by weight, in the soda after extraction of the disulphides limits the extraction performance in countercurrent. Because of this, the amount of mercaptans extracted in the extractor is decreased on account of the excessive presence of residual sodium thiolates in the soda.

The maximum permissible content of sodium thiolates in the regenerated soda depends both on the permissible sulphur content in the refined hydrocarbon, on the performance or number of theoretical stages of the extraction column, and on the ratio between the flow rates of soda and of hydrocarbon in the extraction column.

The principle of the proposed invention consists of using an extraction column with a double feed of soda. The partially regenerated soda, i.e. still containing a large quantity of sodium thiolates, is injected into the column at an intermediate height, whereas a flow of so-called "clean" soda, with a lower quantity of sodium thiolates, is injected into the top of the column. The partially regenerated soda has a quantity of sodium thiolates between 20 and 600 ppm, expressed as sulphur fraction by weight. The clean soda solution has a quantity of sodium thiolates between 0 and 50 ppm.

SUMMARY OF THE INVENTION

Figure 1:
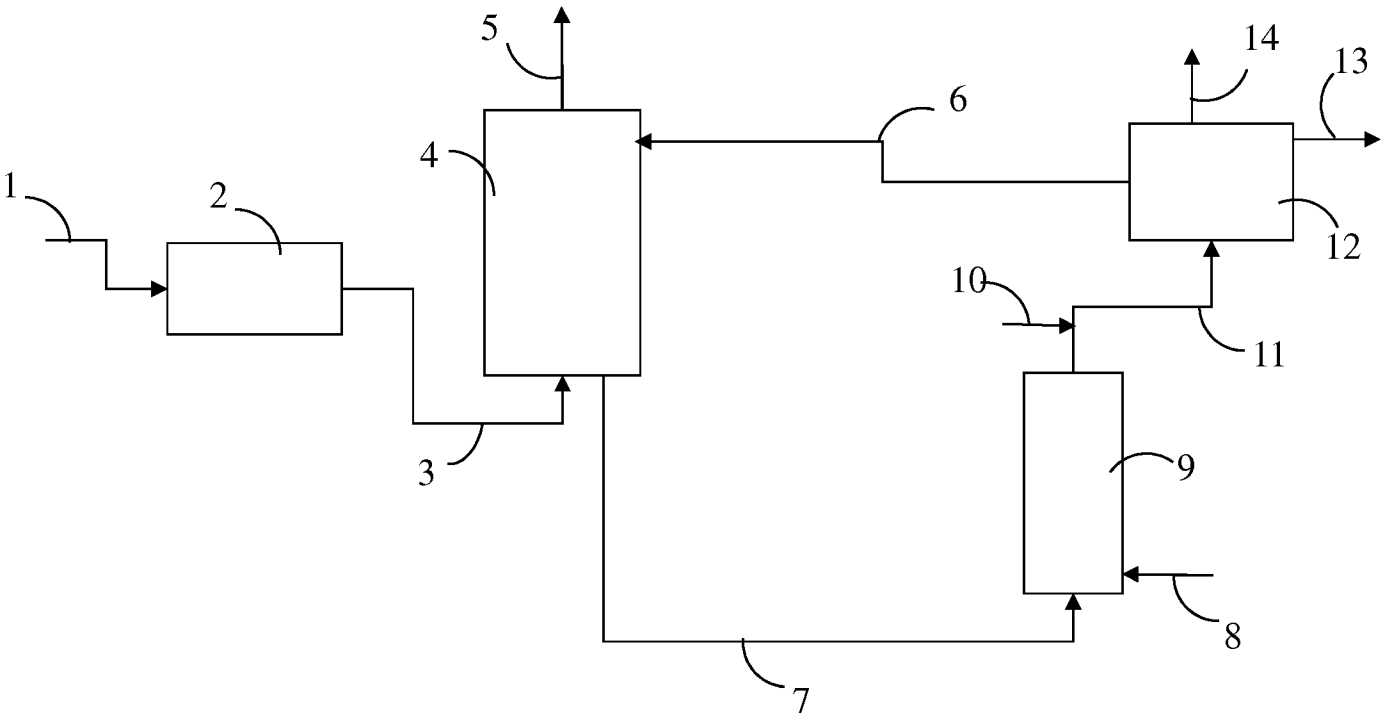
FIG. 1 shows a version of the device according to the prior art. The extraction column (4) employs a single soda circuit, wherein the soda leaving the extraction column (4) at the bottom, laden with sodium thiolates, is regenerated in an oxidation reactor (9), then washed in the separating chamber (12) by means of a hydrocarbon cut (10), which is generally gasoline. The regenerated soda (6) is recycled to the top of the extraction column (4).

The process according to the present invention can be defined as a process of extracting the sulphur-containing compounds from a hydrocarbon cut of the gasoline or LPG type by liquid-liquid extraction with a soda solution employing a unit (2) for pretreatment of the feedstock to be treated placed upstream of the extraction unit (4), the soda being introduced into column (4) in the form of two separate circuits arranged either in parallel, or in series.

In a first variant of the process according to the invention, the two soda circuits operate in parallel:

- the first circuit taking the used soda at the bottom of column (4) employing a first oxidation reactor (9) and a first vessel (12) for separating the soda leading to a partially regenerated soda (6), which is reintroduced at an intermediate point of extraction column (4) so that said column is divided into an upper compartment situated between said intermediate point of reintroduction and the top end of column (4), and a lower compartment situated between said intermediate point of reintroduction and the point of withdrawal of the used soda (7) situated at the bottom of extraction column (4),
- the second circuit being a circuit of clean soda (16) introduced in the upper compartment of the column, withdrawal of clean soda (17) being carried out from the upper compartment, which is then returned to the feed pipe for clean soda (16) and the ratio R2 of the flow rate (17) of clean soda taken from the upper compartment of extraction column (4) to the flow rate of clean soda (16) reintroduced in the upper part of the column is between 1 and 10 and preferably between 1 and 5.

In a second variant of the process according to the invention, the two soda circuits operate in series:

- the first circuit takes the used soda at the bottom of column (4) and employs a first oxidation reactor (9) and a first vessel (12) for separating the soda leading to a partially regenerated soda (6), one part (24) of the partially regenerated soda (6) being sent to the second regeneration circuit, and the other part of the flow of the partially regenerated soda (6') being reintroduced at an intermediate point of extraction column (4) so as to separate said column into an upper compartment situated between said intermediate point of reintroduction and the upper end of column (4), and a lower compartment situated between said intermediate point of reintroduction and the point of withdrawal of the used soda (7) situated at the bottom of extraction column (4),
- the second regeneration circuit relates to the flow (24) of the partially regenerated soda and employs a second oxidation reactor (25), a second separating vessel (18), and a third separating vessel (19), leading to a clean soda, the flow of clean soda (16) being reintroduced at the top point of extraction column (4).

The process of extracting sulphur-containing compounds from a hydrocarbon cut of the gasoline or LPG type according to the present invention therefore uses, as operating variable, the ratio R1 of the flow rate of the partially regenerated soda (24) entering the second oxidation reactor (25) to the flow rate of the partially regenerated soda (6) leaving the first separating vessel (12), said ratio R1 being between 0.01 and 0.25 and preferably between 0.05 and 0.15.

The process of extracting sulphur-containing compounds from a hydrocarbon cut of the gasoline or LPG type according to the present invention uses, as another operating variable, a second ratio R2 of the flow rate (17) of clean soda taken from the upper part of the extraction column (4) to the flow rate of clean soda (16) reintroduced into the upper part of the column, said ratio R2 being between 0.5 and 10 and preferably between 1 and 5.

The point of reintroduction of the flow of the partially regenerated soda (6') into the extraction column (4) divides said column into two compartments; the upper compartment of extraction column (4) behaves as a single theoretical stage of extraction and the lower compartment of column (4) behaves as a set of N theoretical stages in series, N being between 1 and 4.

DETAILED DESCRIPTION OF THE INVENTION

The present invention relates to a process of extracting sulphur-containing compounds present in a hydrocarbon cut, in the case when the main sulphur-containing species are mercaptans, denoted RSH, for example methanethiol $CH_3SH$, ethanethiol $C_2H_5SH$, propanethiol $C_3H_7SH$, and/or other sulphur-containing species are also present, such as hydrogen sulphide $H_2S$ or carbonyl sulphide COS.

FIG. 1 illustrates the process used for extracting sulphur-containing species according to the prior art. The hydrocarbon cut 1 enters a pretreatment chamber 2 previously filled with soda solution diluted to a concentration between 2 and 10% by weight.

The treated hydrocarbon feedstock leaves the pretreatment by pipeline 3. The soda solution in pretreatment chamber 2 is renewed according to an operating cycle of between 3 and 30 days, depending on the age of the soda. The pretreatment extracts a variable amount of sulphur-containing species, including mercaptans.

The hydrocarbon feedstock (3) then enters an extraction column in countercurrent (4), at the bottom of said column. The extraction column (4) is also supplied with regenerated soda solution (6), at the top of the column. The concentration of soda is then between 15 and 25% by weight.

The function of extraction column (4) is to extract most of the mercaptans still present in the hydrocarbon feedstock.

The hydrocarbon feedstock, thus refined, leaves column (4) by pipeline (5).

The soda leaving column (4) by pipeline (7) is laden with species of the sodium thiolate type RS-Na, corresponding to the mercaptans extracted, dissociated and recombined with sodium ions $Na^+$.

The flow (7) enters an oxidation reactor (9), also supplied with air via pipeline (8).

The presence of air and of a catalyst dissolved in the soda solution promotes the reaction of oxidation of the sodium thiolates to disulphides, denoted RSSR. The catalyst used can be from the family of cobalt phthalocyanines.

The multiphase medium leaving the oxidation reactor (9) by pipeline (11) is sent to a separating vessel (12). A flow (10) of a gasoline cut or of some other hydrocarbon is injected into the soda solution upstream of the separating vessel (12), for example in pipeline (11).

This flow makes it possible to extract the disulphides and to recover, by decanting in the separating vessel (also called a settling tank) (12), a hydrocarbon cut highly enriched in sulphur-containing species (13).

The depleted air leaves the settling tank (12) by pipeline (14).

The soda thus regenerated is returned to the top of extraction column (4) by pipeline (6).

Sometimes a separating vessel (not shown in FIG. 1) is added on line (6) in order to optimize the extraction of disulphides with the hydrocarbon cut. In this case, the hydrocarbon cut (10) used for extracting the disulphides is injected into line (6), and it is then decanted in the additional separating vessel.

The hydrocarbon cut then leaving the additional vessel is sent into line (7).

Figure 2:
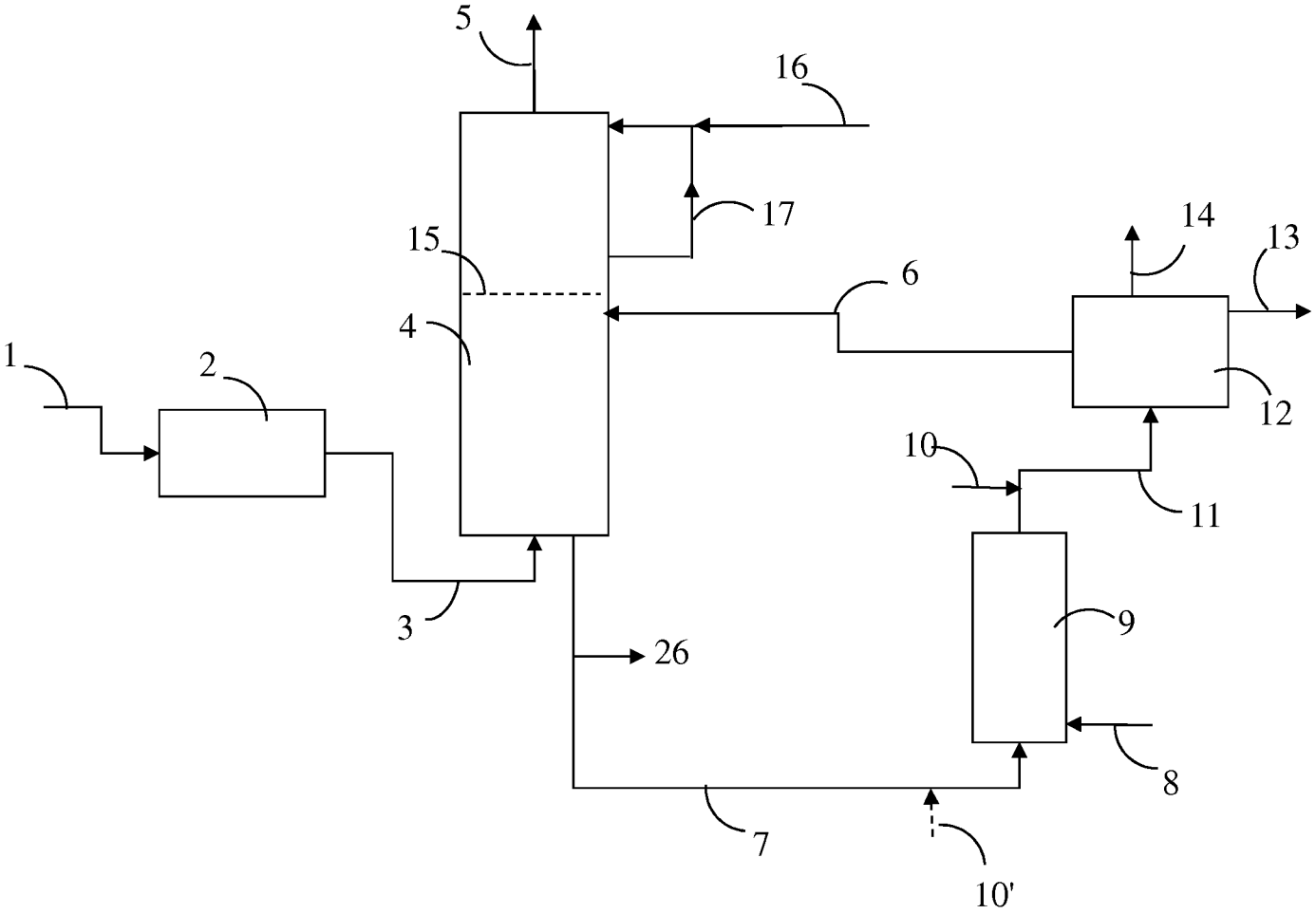
FIG. 2 shows a version of the process according to the invention. The extraction column (4) has a lower zone for extraction with regenerated soda still partially laden with sodium thiolates, called partially regenerated soda, and an upper zone for extraction with fresh clean soda. There are therefore two soda circuits for providing extraction of the sulphur-containing products in the extraction column (4).

FIG. 2 illustrates a first version of the process according to the invention. In contrast to the process according to the prior art described in FIG. 1, the regenerated soda (6) is injected at a certain intermediate height of extraction column (4). This point of introduction of the partially regenerated soda delimits two compartments of extraction column (4), an upper compartment between said point of introduction and the top of the column and a lower compartment between said point of introduction and the bottom of the column.

The upper compartment is used for performing an extraction with fresh soda (16), not containing sodium thiolates.

The treated hydrocarbon always leaves extraction column (4) by the top pipeline (5).

The extraction column (4) can be equipped with an internal device (15) limiting the backmixing of the phases between the two, upper and lower, compartments.

In a preferred configuration of this first variant, the upper compartment functions as a single theoretical stage.

The clean soda (16) can be recycled to the upper compartment of column (4) so as to increase the flow rate of the soda and consequently the exchange surface between the phases. This is effected by withdrawing soda (17) from the upper compartment, which is then returned to the feed pipe for clean soda (16).

This operation of recycling of the clean soda is all the more advantageous when the flow rate of clean soda injected (16) is very low compared to the flow rate of the hydrocarbon feedstock to be treated (3).

A soda purge (26) is necessary on the clean soda loop to keep the amount of soda constant. It can be carried out for example on the pipeline leaving at the bottom of extraction column (4).

Figure 3:
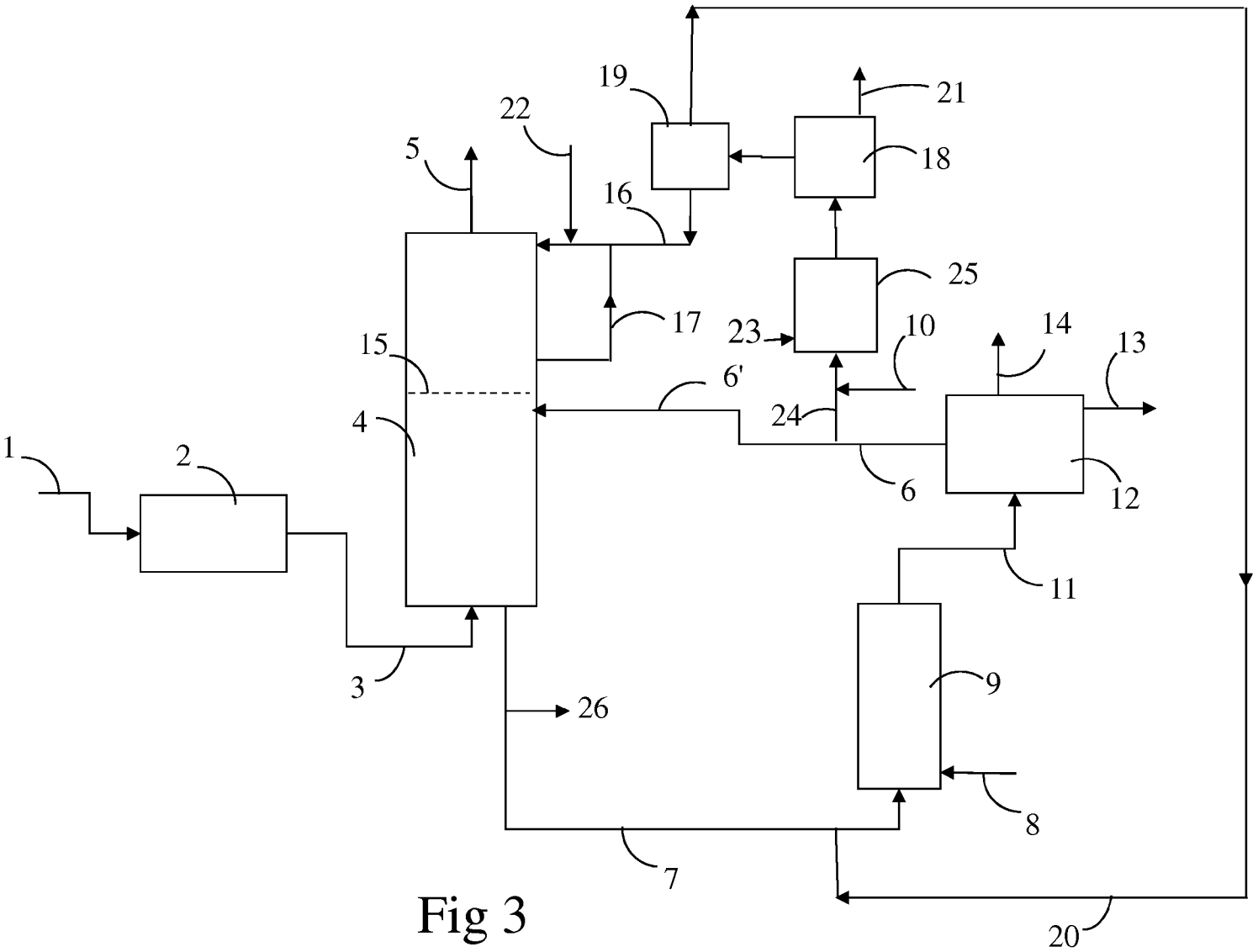
FIG. 3 shows another version of the process according to the invention. The extraction column (4) contains a lower zone for extraction with partially regenerated soda, and an upper zone for extraction with clean soda, this clean soda being received from a second section for oxidation and extraction of disulphides, and consisting of a fraction of the flow of the partially regenerated soda from the first regeneration section.

FIG. 3 illustrates the preferred version of the process according to the invention.

The extraction column (4) is also compartmentalized into an upper compartment situated above the point of introduction of the partially regenerated soda (6'), and a lower compartment situated below the point of reintroduction of the partially regenerated soda (6'). As in the version corresponding to FIG. 2, the mercaptans are extracted with partially regenerated soda in the lower part of column (4), and with clean soda (17) in the upper part of the column (4).

The variant of the process according to FIG. 3 has a scheme for treatment of the regenerated soda that is more elaborate than in the variant corresponding to FIG. 2, and leads to the creation of the flow of clean soda (16) from one part (24) of the flow of partially regenerated soda (6).

The soda laden with disulphides (11) leaving the oxidation reactor (9) is sent to a separating vessel (12). The depleted air leaves the separating vessel (12) by pipeline (14). The hydrocarbon phase laden with disulphides leaves the vessel by pipeline (13).

The partially regenerated soda (6) leaving the separating vessel (12) is divided into two streams:

- flow (6') injected at an intermediate height of the extraction column (4), and
- flow (24) returned to a second oxidation reactor (25).

The flow rate of flow (24) represents from 1 to 25% by weight of the flow rate of the partially regenerated soda (6). This flow (24) preferably represents from 5% to 15% of flow (6).

The second oxidation reactor (25) is used for converting the residual sodium thiolates present in flow (24) to disulphides. For this, a flow of air (23) is sent to the bottom of the second oxidation reactor (25).

The multiphase mixture leaving the second oxidation reactor (25) is then separated in one or two separating vessels (18) and (19).

In the version shown diagrammatically in FIG. 3, a first separating vessel or settling tank (18) is used for separating the mixture from the depleted air (21), then a second separating vessel or settling tank (19) is used for separating the clean soda (16) from the hydrocarbon containing the disulphides (20).

The hydrocarbon used for extracting the disulphides from the soda is introduced by pipeline (10) upstream of the second oxidation reactor (25).

The flow (20) laden with disulphides and leaving the second settling tank (19) is recycled to the inlet of the first oxidation reactor (9).

A supplement of fresh soda (22) can be injected at the top of extraction column (4).

A certain volume flow of used soda necessary for ensuring the material balance is purged from the loop via pipeline (26).

In the two variants of the process (corresponding to FIG. 2 and FIG. 3) according to the invention, by employing an extraction zone for the clean soda located in the upper compartment of extraction column (4) there is a notable improvement in performance for the extraction of mercaptans, as is demonstrated in the examples given below.

The technology of the extraction column (4) is selected so as to maximize the areas of contact between the phases in its upper compartment. In this upper compartment, the flow (17) supplying the clean soda loop is withdrawn in a zone essentially occupied by the soda phase, so as not to entrain a large amount of hydrocarbon. Preferably, the flow rate of recirculation of soda Q17 in the upper part of column (4) is fixed at 10 times the flow rate Q16 entering via pipeline (16).

Ideally the upper compartment of extraction column (4) behaves as a single theoretical stage of extraction, whereas the lower compartment of column (4) behaves as from 1 to 4 theoretical stages of extraction, preferably from 1 to 2 theoretical stages.

EXAMPLES

The invention will be better understood on reading the comparative examples given below.

Comparative Examples

Consider a unit for the extraction of mercaptans present in a hydrocarbon phase of the LPG type, a mixture of alkanes and alkenes with 2, 3 and 4 carbon atoms.

The process is similar in all respects to that described in FIG. 3. The pretreatment consists of a prewashing vessel (2) of 10 $m^3$ filled to ⅔ with soda solution at 6% by weight, renewed every 10 days.

The hydrocarbon feedstock to be treated (1) has a flow rate of 15 $m^3$/h, and contains 115 ppm of methyl mercaptans, 10 ppm of COS and 10 ppm of $H_2S$.

The flow rate Q7 of soda at the bottom of extractor (4) is 1 $m^3$/h, and its soda content is 18% by weight. The process operates at 7 bar absolute.

Various operating modes were simulated in order to demonstrate the advantages of the invention.

The operating parameter is:

- volume ratio R of the flow of soda Q24 directed to the second oxidation reactor (25) to the flow of regenerated soda Q6 leaving the separating vessel (12). The flow (6') directly reintroduced into the extraction column (4) is equal to the difference of flow (6) and flow (24).

The following are measured:

the content M in ppm by weight of sulphur in the soda at the outlet of the three-phase settling tank (12), i.e. on flow (6). This content is the same in lines (6) and (24).

the sulphur content S in the refined LPG, i.e. at the outlet of the process on flow (5).

The cases 1 to 3 for which the flow Q24 is zero are the cases according to the prior art (cf. FIG. 1).

The cases 4 to 7 for which the flow Q24 is not zero, are the cases according to the present invention.

The dimensioning of the second oxidation reactor (25) is such that the soda at the outlet no longer contains sodium thiolates and is saturated with dissolved oxygen.

Accordingly, a small amount of oxygen is returned to the extraction column (4), and this oxygen is converted at 100% to disulphides in extraction column (4).

Moreover, the flow rate of recirculation of soda Q17 in the upper part of column (4) is fixed at 10 times the flow rate Q16 entering by pipeline (16).

The results of the simulations are presented in Table 1 below in terms of the total quantity S of sulphur in the LPG leaving from the top of the extractor (flow 5) and of content M in ppm by weight of sulphur in the soda at the outlet of the three-phase settling tank (12), i.e. on flow (6).

TABLE 1

| No. | R (%) | M (ppm by weight S) | S (ppm by weight S) |
|---|---|---|---|
| 1 | 0 | 100 | 1.2 |
| 2 | 0 | 200 | 1.8 |
| 3 | 0 | 400 | 3.2 |
| 4 | 1% | 400 | 2.66 |
| 5 | 5% | 400 | 1.6 |
| 6 | 11% | 400 | 1.12 |
| 7 | 25% | 400 | 0.84 |

Several important points should be noted from these results.

1) If the content of mercaptans (M) at the outlet of settling tank (12) is zero or near 0, the content of sulphur (S) in the refined LPG is not negligible, as the oxygen dissolved in the soda is not consumed by the sodium thiolates before the three-phase separating vessel (12), and therefore induces formation of disulphides in the extraction column.

The disulphides formed are then extracted by the LPG and therefore leave from the top of the extraction column (4).

2) The sulphur content S in the refined LPG increases with M. But, and this is the main advantage of the invention, for one and the same content M of mercaptans, the process according to the invention is accompanied by a decrease in content of S in the refined LPG. This is what is shown by the comparison of case 3 according to the prior art and case 4 according to the invention with a very low ratio R (1%).

3) The ratio R of the flow rate of the partially regenerated soda (24) sent to the second oxidation reactor (25) to the flow rate of the partially regenerated soda (6) leaving separating vessel (12) has a very favourable effect on the overall efficiency of the process, as S decreases very markedly with R. For example (case 7), S drops to 0.84 ppm for a ratio R of 25%.

The invention claimed is:

1. A process of extracting sulphur-containing compounds from a hydrocarbon cut of gasoline or LPG comprising:

subjecting said hydrocarbon cut to liquid-liquid extraction with a soda solution, implemented in a pretreatment unit (2) for pretreatment of said hydrocarbon cut, and further subjecting said hydrocarbon cut to liquid-liquid extraction with a soda solution in an extraction column (4) having a top and a bottom, wherein said pretreatment unit (2) is positioned upstream of said extraction column (4), and wherein soda solution is introduced into said extraction column (4) via a first circuit and a second circuit that function as follows:

said first circuit removes used soda solution from the bottom of said extraction column (4) at a point of withdrawal and introduces said used soda solution into a first oxidation reactor (9) and then into a first separating vessel (12) for separating the soda solution resulting in the production of a partially regenerated soda solution (6), a first part (6') of said partially regenerated soda solution is then introduced at an intermediate point of said extraction column (4) so as to separate said column into an upper compartment situated between said intermediate point and an upper end of said extraction column (4), and a lower compartment situated between said intermediate point and said point of withdrawal of used soda solution (7) at the bottom of said extraction column (4), and said second circuit introduces a clean soda solution (16) at the top of said extraction column (4) via a feed pipe, withdraws soda solution (17) from said upper compartment, and then returns the soda solution (17) to said feed pipe for clean soda solution (16), wherein the ratio R2 of the flow rate of soda solution (17) removed from said upper compartment of said extraction column (4) to the flow rate of clean soda (16) solution introduced at the top of said extraction column (4) is between 1.0 and 10.

2. The process according to claim 1, wherein the upper part of said extraction column (4) functions as a single theoretical stage of extraction and the lower compartment of said extraction column 4 functions as a set of N theoretical stages in series wherein N is between 1 and 4.

3. The process according to claim 1, wherein said partially regenerated soda solution (6) from said first separating vessel (12) is split into said first part (6') of said partially regenerated soda solution and a second part (24) of said partially regenerated soda solution, and said second part (24) of said partially regenerated soda solution is sent to a second oxidation reactor (25), then to a second separating vessel (18), and then to a third separating vessel (19), and clean soda solution (16) is removed from said third separating vessel (19) and sent to said feed pipe for introducing clean soda solution (16) at the top of said extraction column (4).

4. The process according to claim 3, wherein the ratio R1 of the flow rate of said second part of partially regenerated soda solution (24) entering said second oxidation reactor (25) to the flow rate of partially regenerated soda (6) removed from said first separating vessel (12) is between 0.01 and 0.25.

5. The process according to claim 3, wherein the ratio R1 of the flow rate of said second part of partially regenerated soda solution (24) entering said second oxidation reactor (25) to the flow rate of partially regenerated soda (6) removed from said first separating vessel (12) is between 0.05 and 0.15.

6. The process according to claim 3, wherein the ratio R2 of the flow rate of soda solution (17) removed from said upper compartment of said extraction column (4) to the flow rate of clean soda solution (16) introduced at the top of said extraction column (4) is between 1 and 5.

7. The process according to claim 4, wherein the ratio R2 of the flow rate of soda solution (17) removed from said upper compartment of said extraction column (4) to the flow rate of clean soda solution (16) introduced at the top of said extraction column (4) is between 1 and 5.

8. The process according to claim 5, wherein the ratio R2 of the flow rate of soda solution (17) removed from said upper compartment of said extraction column (4) to the flow rate of clean soda solution (16) introduced at the top of said extraction column (4) is between 1 and 5.

9. The process according to claim 3, wherein the flow rate of said second part of partially regenerated soda solution (24) represents from 1 to 25% by weight of the flow rate of partially regenerated soda (6) removed from said first separating vessel (12).

10. The process according to claim 3, wherein the flow rate of said second part of partially regenerated soda solution (24) represents from 5% to 15% by weight of the flow rate of partially regenerated soda (6) removed from said first separating vessel (12).

11. The process according to claim 1, wherein a flow (10') of hydrocarbon is injected into the used soda solution upstream of said first separating vessel (12) to extract disulfides and to recover soda solution by decanting in said first separating vessel (12).

12. The process according to claim 1, wherein air (8) is introduced into said oxidation reactor (9) to promote oxidation of the sodium thiolates to disulfides.

13. The process according to claim 11, wherein air (8) is introduced into said oxidation reactor (9) to promote oxidation of the sodium thiolates to disulfides.

14. The process according to claim 3, wherein air (8) is introduced into said oxidation reactor (9) to promote oxidation of the sodium thiolates to disulfides, a flow (10) of hydrocarbon is injected into said second part of partially regenerated soda solution (24) upstream of said said second oxidation reactor (25) to extract disulfides, and air (23) is introduced into second oxidation reactor (25) to convert residual sodium thiolates to disulfides.

15. The process according to claim 1, wherein the upper part of said extraction column (4) functions as a single theoretical stage of extraction and the lower compartment of said extraction column 4 functions as a set of N theoretical stages in series wherein N is between 1 and 2.

* * * * *